US010393123B2

(12) United States Patent
Gundel et al.

(10) Patent No.: US 10,393,123 B2
(45) Date of Patent: Aug. 27, 2019

(54) FAN UNIT

(71) Applicant: Nicotra Gebhardt GmBH, Waldenburg (DE)

(72) Inventors: Klaus Gundel, Kupferzell-Belzhag (DE); Thomas Heigold, Künzelsau (DE); Walter Müller, Weinsberg (DE)

(73) Assignee: Nicotra Gebhardt GmbH, Waldenburg (DE)

( * ) Notice: Subject to any disclaimer, the term of this patent is extended or adjusted under 35 U.S.C. 154(b) by 154 days.

(21) Appl. No.: 15/387,205

(22) Filed: Dec. 21, 2016

(65) Prior Publication Data

US 2017/0175747 A1 Jun. 22, 2017

(30) Foreign Application Priority Data

Dec. 22, 2015 (DE) ..... 10 2015 226 575

(51) Int. Cl.

| | |
|---|---|
| ***F04D 17/16*** | (2006.01) |
| ***F04D 29/28*** | (2006.01) |
| ***F04D 29/44*** | (2006.01) |
| ***F04D 29/42*** | (2006.01) |

(52) U.S. Cl.

CPC ..... *F04D 17/16* (2013.01); *F04D 29/282* (2013.01); *F04D 29/4246* (2013.01); *F04D 29/441* (2013.01)

(58) Field of Classification Search

CPC ..... F04D 17/16; F04D 29/282; F04D 29/441; F04D 29/4246

USPC ..... 415/206

See application file for complete search history.

(56) References Cited

U.S. PATENT DOCUMENTS

| | | | | |
|---|---|---|---|---|
| 3,759,627 | A * | 9/1973 | Ehlinger | F04D 29/441 415/178 |
| 6,030,186 | A * | 2/2000 | Tang | F04D 17/165 415/119 |
| 8,142,147 | B2 * | 3/2012 | O'Connor | F04D 29/4246 415/204 |
| 8,767,400 | B2 * | 7/2014 | Dickinson | F04D 25/166 165/104.33 |
| 2014/0178194 | A1 | 6/2014 | Tamaoka et al. | |

FOREIGN PATENT DOCUMENTS

| | | | | |
|---|---|---|---|---|
| EP | 0091228 | A1 * | 10/1983 | F04D 25/166 |
| JP | 2003028095 | A | 1/2003 | |

* cited by examiner

*Primary Examiner* — Justin D Seabe
*Assistant Examiner* — Joshua R Beebe
(74) *Attorney, Agent, or Firm* — Edell, Shapiro & Finnan LLC

(57) ABSTRACT

A fan unit comprises at least one radial fan comprising: an impeller rotationally driven about a rotation axis; and a fan housing in which the impeller is arranged, the fan housing including a guide wall spirally extending around the fan housing in a circumferential direction of the impeller, the guide wall transitioning into air outlet openings, wherein the guide wall has spirally shaped guide wall segments in the circumferential direction, each of which transitions into one of the air outlet openings, such that the air outlet openings are distributed in the circumferential direction of the impeller.

18 Claims, 4 Drawing Sheets

FAN UNIT

CROSS REFERENCE TO RELATED APPLICATIONS

This application claims foreign priority under 35 U.S.C. § 119(a)-(d) to Application No. DE 102015226575.7 filed on Dec. 22, 2015, the entire contents of which are hereby incorporated by reference.

FIELD OF THE INVENTION

The invention relates to a fan unit having at least one radial fan, having a fan housing in which an impeller rotationally driven about a rotation axis is arranged, wherein the fan housing has a guide wall spirally stretching around in a circumferential direction of the impeller which transitions into an air outlet opening.

BACKGROUND

Radial fans can in principle be classified into two different categories: one group being formed by radial fans with spiral housing and the other group by free-running radial fans.

The spiral housing of the radial fans in the first group has two objects to fulfill. It collects the outflowing air from the impeller, guides it to a common discharge point and converts a portion of the kinetic energy (dynamic pressure) into pressure energy (static pressure) through the steady cross-sectional expansion in the flow direction (diffusion effect). In free-running radial fans, the air in the impeller is diverted in a radial direction and flows out there at the blade discharge diameter of the impeller. To increase the degree of static efficiency, diffusers are already known where the cover disc and bottom disc of the impeller have outer edge areas protruding from the blade discharge diameter.

SUMMARY

The object of the invention is to create a fan unit of the aforementioned type which, in a compact design, has an improved degree of efficiency compared to conventional fan units with a free-running radial fan.

The fan unit according to the invention is characterized in that the guide wall is segmented in the circumferential direction and has a plurality of spirally designed guide wall segments which each transition into their own air outlet opening, in such a manner that the fan housing has a plurality of air outlet openings distributed in the circumferential direction of the impeller.

The invention now selects an approach to improve radial fans with spiral housing in such a manner that the advantages of the spiral housing—high stability, targeted airflow—are maintained and the degree of static efficiency improved to the extent that the fan unit according to the invention having the radial fan with spiral housing has a higher degree of efficiency than the free-running radial fan.

In contrast to the fan units known from the prior art having at least one radial fan with spiral housing and a single air outlet opening, the fan unit according to the invention has at least two air outlet openings, i.e., the single spiral formed by the spiral housing known from the prior art is, according to the invention, divided into several partial spirals by the segmented guide wall. The radially diverted air in the impeller is therefore, in contrast to the prior art, not collected in a spiral and transported to the air outlet opening, but is instead collected in multiple partial spirals and led to the respective air outlet opening.

In addition to the increase in the degree of static efficiency, this also positively affects the dimensions, which are smaller compared to conventional radial fans with only one air outlet opening. As a result, the fan according to the invention is also suitable—at an equal volumetric flow to be transported compared to conventional radial fans with spiral housing—due to the significantly more compact design, for installation in any arrangement that allows a free intake and free discharge, for example, in smaller duct cross-sections of ventilation or air conditioning housings, for example air conditioning cabinets or air conditioning ducts.

In a further embodiment of the invention, the guide wall segments each have an inner guide wall segment section and an outer guide wall segment section, where the air outlet openings are formed by the adjacent inner and outer guide wall segment sections of the guide wall segments arranged immediately after one another in the circumferential direction of the impeller.

In a particularly preferred manner, the guide wall segments are arched outwards, where an air outlet nozzle protrudes between each adjacent guide wall segment in the circumferential direction whose longitudinal axis is parallel or at an angle to a tangent to the impeller. Overall, at least two air outlet nozzles can be provided which each border the air outlet openings. The cross-sectional area of the air outlet opening is in particular rectangular, for example square.

In a further embodiment of the invention, at least two of the air outlet openings are diametrically opposite relative to the rotation axis of the impeller.

It is possible for the fan housing to have a rectangular basic form and for the air outlet openings to be situated at the corner areas of the fan housing.

In a particularly preferred manner, four air outlet openings distributed in the circumferential direction of the impeller are provided. In this case, the air can therefore be collected by four partial spirals and directed to the associated air outlet openings. In the case of a rectangular-shaped fan housing and four air outlet openings, the fan housing could also be known as quad housing.

In a further embodiment of the invention, the fan housing has a suction-side side wall provided with a suction opening and a drive-side side wall opposite this to which a fan drive is assigned, where the impeller is accommodated between the suction-side side wall and the drive-side side wall.

In a particularly preferred manner, the drive-side side wall has a mounting interface for mounting a fan drive. In comparison to free-running radial fans, radial fans with a fan housing are more stable and therefore suitable for mounting the fan drive directly onto the fan housing. The combination of the fan housing and the impeller accommodated therein with the mounted fan drive is therefore more compact than the drive plus impeller in a free-running radial fan.

In a further embodiment of the invention, the fan unit has an air-conditioning housing in which the radial fan is accommodated. The air-conditioning housing can be, for example, an air-conditioning cabinet which can be, for example, part of a central air-conditioning unit. Alternatively, the air-conditioning housing can also be an air-conditioning duct. Of course, it would also be possible to arrange the radial fan in a ventilation housing, for example in a ventilation duct.

In a particularly preferred manner, the radial fan is inserted into the air-conditioning housing in such a manner that a discharge zone is formed between the air outlet openings and an associated air-conditioning housing wall of the air-conditioning housing.

In a further embodiment of the invention, the air-conditioning housing has multiple, for example four, air-conditioning housing walls particularly oriented at right angles to each other, each of which is assigned an air outlet opening of the radial fan. Expediently, the mouth areas of the air outlet openings and the associated air-conditioning housing walls form an angle, and are therefore not arranged parallel to each other, allowing an optimized air discharge to be achieved. It is therefore possible to insert the radial fan into the air-conditioning housing so that it is twisted to a certain extent towards the air-conditioning housing walls, causing the air outlet openings to be focused in the direction of the corners between the air-conditioning housing walls adjacent to each other.

In a further embodiment of the invention, the fan unit has an intermediate cover hanging below the housing cover in which the radial fan is accommodated.

It is possible for the fan unit to have an intermediate floor arranged above a housing floor in which the radial fan is accommodated.

BRIEF DESCRIPTION OF THE DRAWINGS

Example embodiments of the invention are illustrated in the drawings and explained in further detail below. In the drawings.

DETAILED DESCRIPTION

Figure 1:
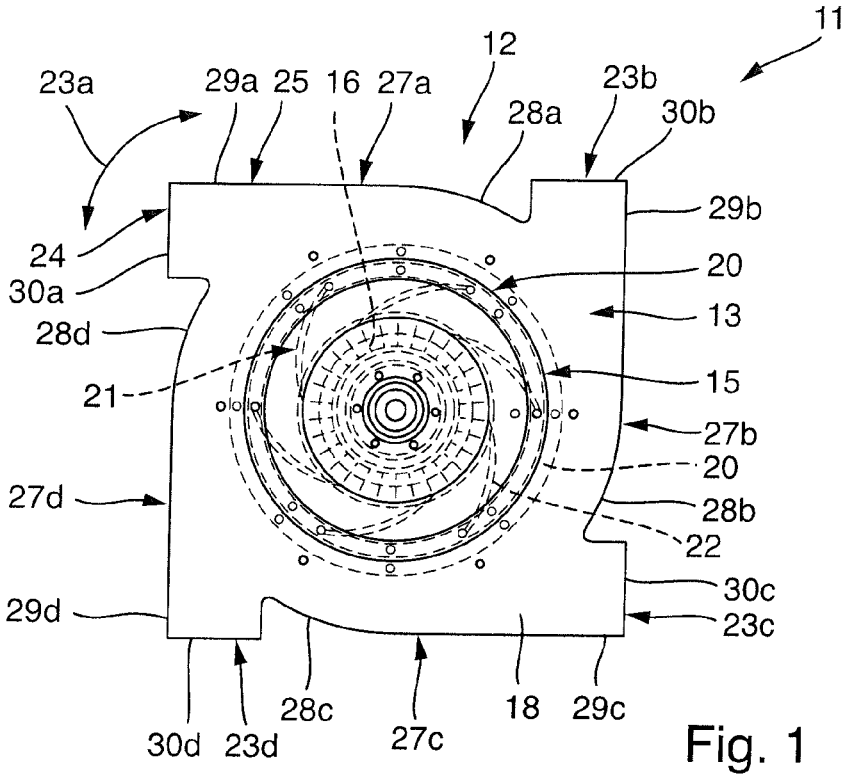
FIG. 1 shows a side view of a first exemplary embodiment of the fan unit according to the invention.
Figure 2:
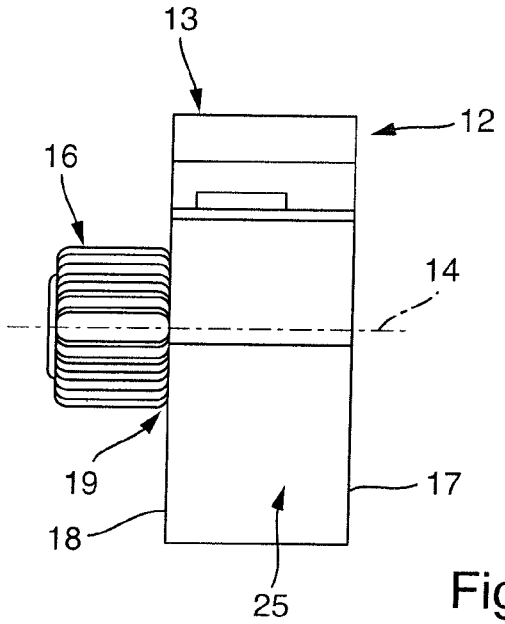
FIG. 2 shows a circumferential view of the fan unit of FIG. 1.

FIGS. 1 and 2 show a first exemplary embodiment of the fan unit 11 according to the invention. The main part of the fan unit 11 is a radial fan 12 which has a fan housing 13 in which an impeller 15 rotationally driven about a rotation axis 14 is arranged.

The fan housing 13 is designed in the shape of a box and has two side walls 17, 18 which are parallel to each other and are arranged at a distance from one another, wherein the impeller 15 is accommodated in the space between the two side walls.

A suction-side side wall 17 is provided which is equipped with an inlet opening (not shown) which defines a suction diameter. The inlet opening is situated on the outside of the suction-side side wall 17, where the area flowing through can expand, for example in the shape of a trumpet, according to the outline of the suction-side side wall 17.

The drive-side side wall 18 is arranged opposite to the suction-side side wall 17. A mounting interface 19, on which the fan drive 16 is mounted, is situated on the drive-side side wall 18. As shown in FIG. 1 in particular, the mounting interface 19 includes a drive support 20 in the form of a mounting flange on which the fan drive 16 is mounted. The fan drive 16 is preferably an electric motor, in particular a permanent magnet synchronous motor. It is also possible, however, to design the fan drive 16 as an asynchronous motor.

As a result of the high stability of the fan housing 13, the drive support 20, along with the fan drive 16, can be mounted directly on the fan housing 13 on the mounting interface 19. For this purpose, the flange-like drive support 20 is fixed to the outside of the drive-side side wall 18 and mounted there via suitable fasteners, for example screwed on using fastening screws. The drive shaft of the fan drive 16 projects through an opening into the inside of the fan housing and supports the impeller 15, which, as previously described, rotates on the inside of the fan housing 13 in the operating state.

The impeller 15 has a blade ring 21 comprising several blades 22 which, for example, can be inclined against the direction of rotation from the inside out.

As displayed in FIG. 1 in particular, the blades 22 are displayed by way of example in the form of backward curved blades 22. Alternatively, however, it would also be possible to use backward inclined straight blades 22.

The fan housing 13 of the radial fan 12 is built as a spiral housing which has the object of collecting the air diverted by the impeller 15 in the radial direction and guiding it to a common air discharge point, an air outlet opening 23. As result, a part of the kinetic energy (dynamic pressure) is converted into pressure energy (static pressure) by the steady cross-sectional expansion in the flow direction.

For this purpose, the fan housing 13 has a guide wall 25 stretching around spirally in a circumferential direction 24 of the impeller 15 which transitions into the air outlet opening 23. The guide wall 25 forms the circumferential end of the side walls 17, 18, and, together with these, forms the box-shaped fan housing 13.

The radial fan 12 according to the invention now has a guide wall 25 segmented in the circumferential direction 24 which has a plurality of guide wall segments 27*a-d*, each designed in spiral form, which each transition into their own air outlet opening 23*a-d*, in such a manner that the fan housing 13 has a plurality of air outlet openings 23*a-d* distributed in the circumferential direction of the impeller 15. In the example shown, the guide wall 25 is segmented into four guide wall segments 27*a-d* and four air outlet openings 23*a-d* are provided, distributed in the circumferential direction 24 of the impeller 15. It is, of course, possible for the number of wall segments 27*a-d* and the number of air outlet openings 23*a-d* to differ from four, namely to be two, three or more than five in number.

As displayed in FIG. 1 in particular, the guide wall segments 27*a-d* each have an inner guide wall segment section 28*a-d* and an outer guide wall segment section 29*a-d*, where the air outlet openings 23*a-d* are formed by the adjacent inner and outer guide wall segment sections 28*a-d*; 29*a-d* of the guide wall segments 27*a-d* arranged immediately after one another in the circumferential direction 24 of the impeller 15.

As further illustrated in FIG. 1, the mouth areas of adjacent air outlet openings 23*a-d* are at right angles to each other. The fan housing 13 has, in the example shown, a rectangular, in particular square, basic form, where the guide wall segments 27*a-d* form the circumferential sides of the fan housing 13 designed in cuboid form.

In the example, two air outlet openings 23*a, c* and 23*b, d* are diametrically opposite each other relative to the rotation axis 14. Applied to the cuboid-like or box-like housing 13, this means that the air outlet openings 23*a-d* each sit at the corner areas of the fan housing 13.

As further shown in FIG. 1, the guide wall segments 27*a-d* are each arched outward, where an air outlet nozzle 30*a-d* protrudes between adjacent guide wall segments 27*a-d* in each case in the circumferential direction 24, the longitudinal axis of the air outlet nozzle being parallel or at an angle to a tangent to the impeller 15.

Each of these air outlet nozzles 30*a-d* constitutes the discharge area of a partial spiral which collects part of the air radially diverted by the impeller 15 and guides it to the associated air outlet opening 23*a-d*. In a variant not shown, the mouth levels of the air outlet nozzles 30*a-d* can project towards or be recessed relative to the outer guide wall segment sections 29*a-d*.

Figure 3:
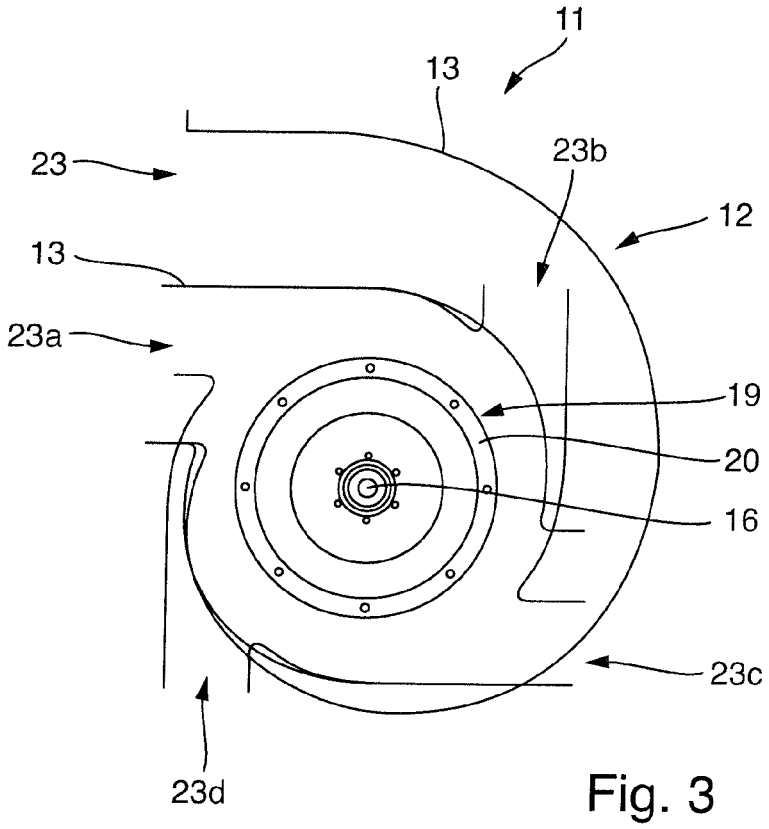
FIG. 3 shows a schematic representation of various fan units, summarized in a diagram, which have single air outlet openings in accordance with the prior art or two or four air outlet openings according to the invention.

FIG. 3 shows a schematic representation of a fan unit of the prior art in which the radial fan has a spiral housing with a single air outlet opening. The same diagram displays the previously described first exemplary embodiment of the fan unit 11 according to the invention, in which the fan housing 13 has four air outlet openings 23*a-d* distributed in the circumferential direction 24 of the impeller 15.

FIG. 3 also displays a second exemplary embodiment of the fan unit 11 according to the invention, in which the fan housing 13 of the radial fan 12 has two air outlet openings 23*a,b* distributed in the circumferential direction 24 of the impeller 15.

As the overview of the various fan units 11 according to the invention and the fan unit of the prior art particularly show, the size of the fan units 11 according to the invention is significantly smaller than that of the fan unit of the prior art.

Figure 4:
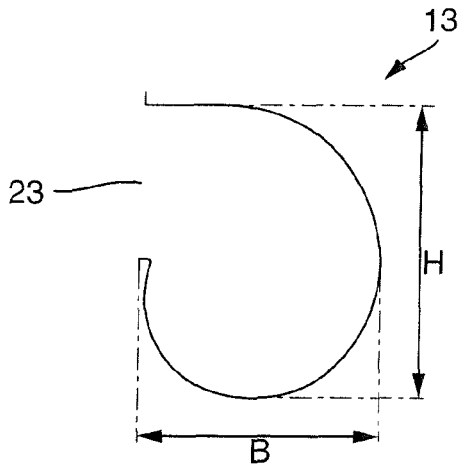
FIG. 4 shows a schematic representation of a fan housing of a fan unit of the prior art.
Figure 5:
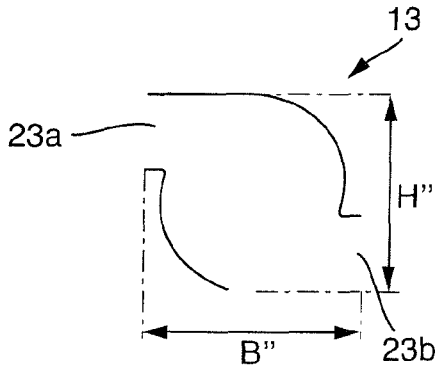
FIG. 5 shows a perspective representation of a second exemplary embodiment of the fan unit according to the invention having two air outlet openings.
Figure 6:
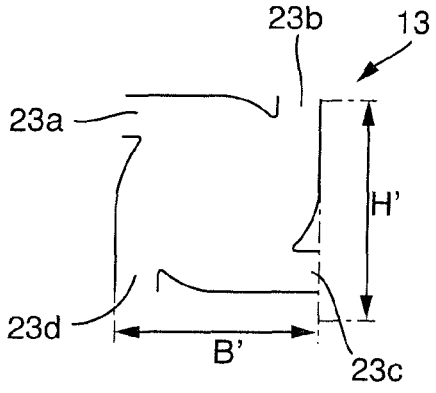
FIG. 6 shows a perspective representation of the fan housing of the first exemplary embodiment of the fan unit according to the invention having four air outlet openings.

As FIGS. 4 to 6 also show, both the width B' of the first exemplary embodiment and the width B" of the second exemplary embodiment are smaller than the width B of the spiral housing of the prior art. The same applies to the height: the height H' and also the height H" are considerably smaller than the height H of the spiral housing of the prior art. The significantly more compact dimensions of the fan units 11 according to the invention allow a substantial reduction in the space required in comparison to fan units of the prior art with same volume flows.

Figure 7:
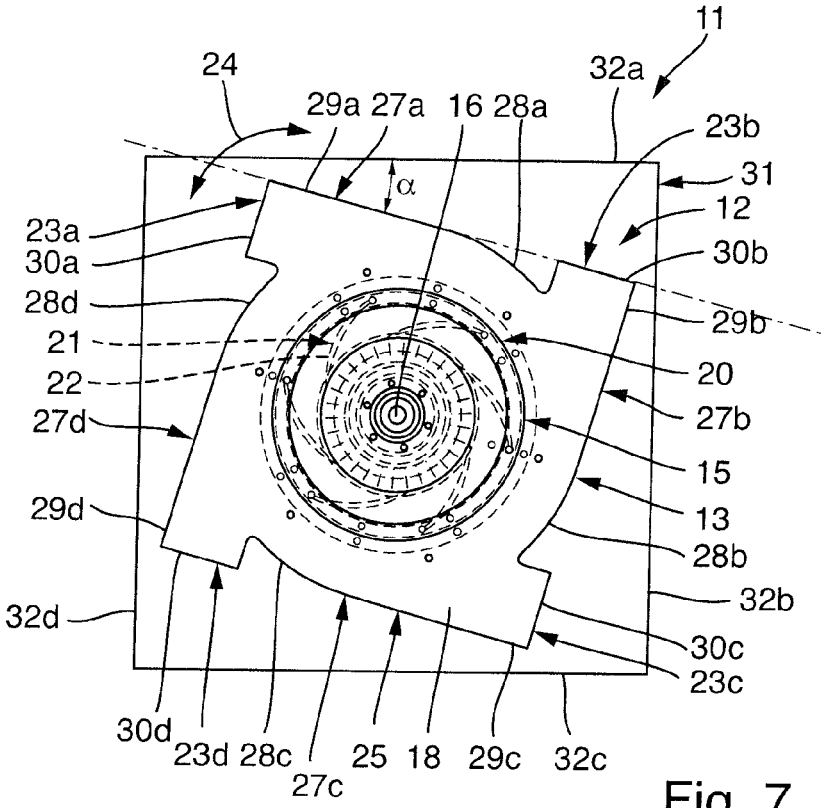
FIG. 7 shows a side view on the first exemplary embodiment of the fan unit according to the invention, wherein the radial fan is inserted in an air-conditioning housing.

FIG. 7 shows a third exemplary embodiment of the fan unit 11 according to the invention. The fan unit 11 of the third exemplary embodiment includes, in addition to a radial fan 12, an air-conditioning housing 31 in which the radial fan 12 is installed. The air-conditioning housing 31 is shown, by way of example, in the form of an air-conditioning cabinet which has a rectangular, particularly square, cross section, and in the example shown has four air-conditioning housing walls 32*a-d* which are perpendicular to each other. To mount the radial fan 12 in the air-conditioning housing 31, a partition wall (not shown) mounted in the air-conditioning housing 31, is used, for example, on which the radial fan 12 can be mounted using suitable fasteners. The radial fan 12 is preferably mounted on the partition wall on the suction-side side wall 17 of the fan housing 13. Alternatively, it is also conceivable to accommodate the radial fan using a stand construction, for example L-shaped stands, or a foot construction in the duct housing.

As displayed in FIG. 7 in particular, each air-conditioning housing wall 32*a-d* is associated with an air outlet opening 23*a-d* of the radial fan 12. However, the mouth areas of the air outlet openings 23*a-d* are not arranged parallel to the associated air-conditioning housing walls 32*a-d*, but instead form an angle with the associated air-conditioning housing wall 32*a-d*. In other words, the radial fan 12 is arranged opposite the air-conditioning housing walls 32*a-d* in a rotating position in which the guide wall segments 27*a-d* are oriented at an angle of $0° < \alpha < 90°$, in particular $5° < \alpha < 45°$, relative to the associated air-conditioning housing walls 32*a-d*.

Such an arrangement of the radial fan 12 enables an optimized air discharge through the individual air outlet openings 23*a-d*. The air outlet openings 23*a-d* and the air outlet nozzles 30*a-d* are aligned with their longitudinal axes in the direction of the corners between two adjacent air-conditioning housing walls 32*a-d*.

Between the air outlet openings 23*a-d* and between their mouth areas and the associated air-conditioning housing walls 32*a-d*, a characteristic discharge zone is thus formed, leading to low losses in the outlet area. Such an air-conditioning cabinet can be, for example, part of a central air-conditioning unit which contains additional components besides the radial fan 12, for example filters, etc.

What is claimed is:

1. A fan unit comprising:

at least one radial fan comprising:

an impeller rotationally driven about a rotation axis; and a fan housing in which the impeller is arranged, the fan housing including a guide wall spirally extending around the fan housing in a circumferential direction of the impeller, the guide wall transitioning into air outlet openings, wherein the guide wall has spirally shaped guide wall segments in the circumferential direction, each of which transitions into one of the air outlet openings, such that the air outlet openings are distributed in the circumferential direction of the impeller;

wherein the fan housing has a suction-side side wall provided with a suction opening and a drive-side side wall opposite the suction-side side wall, wherein the impeller is accommodated between the suction-side side wall and the drive-side side wall, the fan unit further comprising a fan drive associated with the drive-side side wall;

wherein the drive-side side wall has a mounting interface on which the fan drive is mounted;

an air-conditioning housing in which the radial fan is accommodated, said air-conditioning housing having a rectangular cross-section wherein four air-conditioning housing walls intersect at four right angle corners;

wherein the radial fan is mounted in the air-conditioning housing such that a discharge zone is formed between the air outlet openings and at least one associated air-conditioning housing wall; and wherein each of which fan outlet openings is directed generally toward a respective corner of the air-conditioning housing.

2. The fan unit according to claim 1, wherein the fan housing has a rectangular basic form and the air outlet openings are situated at corner areas of the fan housing.

3. The fan unit according to claim 2 wherein the radial fan is mounted to direct airflow from each outlet opening in a direction at an angle to a respective air-conditioning housing wall and toward a respective corner between said air conditioning housing walls, wherein said angle is greater than 0° and less than 90°.

4. The fan unit according to claim 3 wherein said angle is greater than 5° and less than 45°.

5. The fan unit according to claim 4, wherein the drive-side side wall has a mounting interface on which the fan drive is mounted.

6. The fan unit according to claim 4, wherein the air-conditioning housing is configured as an air-conditioning cabinet or as an air-conditioning duct.

7. The fan unit according to claim 1, further comprising an intermediate cover hanging below the fan housing, and an intermediate floor arranged above a housing floor in which the radial fan is accommodated.

8. A fan unit comprising:

at least one radial fan comprising:

an impeller rotationally driven about a rotation axis; and a fan housing in which the impeller is arranged, the fan housing including guide wall spirally extending around the fan housing in a circumferential direction of the impeller, the guide wall transitioning into air outlet openings, wherein the guide wall has spirally shaped guide wall segments in the circumferential direction, each of which transitions into one of the air outlet openings, such that the air outlet openings are distributed in the circumferential direction of the impeller, and wherein each outlet opening terminates in a respective air outlet nozzle for guiding air flowing out from its respective outlet opening; and said fan unit further comprising an air-conditioning housing in which the radial fan is mounted, wherein the air-conditioning housing includes four air-conditioning housing walls situated at right angles to each other to form four respective corners therebetween, and wherein the radial fan is mounted to direct airflow from each nozzle in a direction at an acute angle to a respective housing wall and toward a respective corner between said housing walls.

9. The fan unit according to claim 8 wherein said angle is greater than 0° and less than 90°.

10. The fan unit according to claim 9 wherein said angle is greater than 5° and less than 45°.

11. The fan unit according to claim 8, wherein the fan housing has a suction-side side wall provided with a suction opening and a drive-side side wall opposite the suction-side side wall, wherein the impeller is accommodated between the suction-side side wall and the drive-side side wall, the fan unit further comprising a fan drive associated with the drive-side side wall.

12. The fan unit according to claim 11, wherein the drive-side side wall has a mounting interface on which the fan drive is mounted.

13. The fan unit according to claim 8, wherein the air-conditioning housing is configured as an air-conditioning cabinet or as an air-conditioning duct.

14. The fan unit according to claim 8, wherein the radial fan is inserted into the air-conditioning housing such that a discharge zone is formed between the air outlet openings and respective air-conditioning housing walls.

15. The fan unit according to claim 8, wherein the guide wall segments each have an inner guide wall segment section and an outer guide wall segment section, wherein each of the air outlet openings is formed by adjacent inner and outer guide wall segment sections of guide wall segments arranged adjacent to one another in the circumferential direction of the impeller.

16. The fan unit according to claim 8, wherein the guide wall segments are arched outwards and a respective one of said air outlet nozzles protrudes between adjacent guide wall segments whose longitudinal axis is parallel or at an angle to the impeller.

17. The fan unit according to claim 8, wherein at least two of the air outlets are diametrically opposite relative to the rotation axis of the impeller.

18. The fan unit according to claim 8, wherein the fan housing has a rectangular basic form and the air outlet openings are situated at corner areas of the fan housing.

* * * * *